United States Patent [19]

Carlin et al.

[11] 4,248,680

[45] Feb. 3, 1981

[54] ELECTROLYTIC PROCESS AND APPARATUS

[75] Inventors: William W. Carlin; William B. Darlington, both of Portland; Donald W. DuBois; Roseanne M. Woo, both of Corpus Christi, all of Tex.

[73] Assignee: PPG Industries, Inc., Pittsburgh, Pa.

[21] Appl. No.: 6,069

[22] Filed: Jan. 24, 1979

[51] Int. Cl.[3] ..... C25B 1/34; C25B 11/03; C25B 11/06; C25B 13/08

[52] U.S. Cl. ..... 204/98; 204/128; 204/252; 204/266; 204/291; 204/292; 204/293

[58] Field of Search ..... 204/252–266, 204/290 R, 290 F, 291–293, 98, 128, 296

[56] References Cited

U.S. PATENT DOCUMENTS

| | | | |
|---|---|---|---|
| 3,379,635 | 4/1968 | Doehren | 204/292 |
| 4,025,405 | 5/1977 | Dotson et al. | 204/98 |
| 4,035,254 | 7/1977 | Gritzner | 204/98 |
| 4,065,366 | 12/1977 | Oda et al. | 204/296 |
| 4,080,278 | 3/1978 | Ravier et al. | 204/292 |
| 4,116,804 | 9/1978 | Needes | 204/290 R |

*Primary Examiner*—R. L. Andrews
*Attorney, Agent, or Firm*—Richard M. Goldman

[57] ABSTRACT

Disclosed is an electrolytic cell having an anode, a cathode, and a synthetic fluoro-carbon-resin permionic membrane between the anode and cathode. The improvement is characterized by the fluorocarbon-resin permionic membrane being a fluorinated copolymer having carboxylic acid ion exchange groups and the cathode having a catalytic, non-ferrous surface. Also disclosed is a process of producing an alkali metal hydroxide by electrolyzing an aqueous alkali metal chloride brine in an electrolytic cell having the anode separated from a catalytic, non-ferrous cathode by a synthetic fluorocarbon-resin permionic membrane having carboxylic acid ion exchange groups.

24 Claims, No Drawings

ELECTROLYTIC PROCESS AND APPARATUS

DESCRIPTION OF THE INVENTION

The disclosed invention relates to the production of alkali metal hydroxide and chlorine in an electrolytic cell where the anode is separated from the cathode by a permionic membrane. The electrolytic cell and electrolytic process described herein are characterized by the combination of a fluorocarbon-resin permionic membrane having carboxylic ion exchange groups, and a cathode having a catalytic surface.

The combination of a fluorocarbon resin membrane having carboxylic acid ion exchange groups with a cathode having a catalytic surface is useful in an electrolytic cell where the fluorocarbon resin permionic membrane separates the cathode from an anode. The combination may be utilized in the electrolysis of aqueous alkali metal chloride solutions to produce alkali metal hydroxide. The resulting alkali metal hydroxide is substantially free of alkaline metal chlorides.

The properties of the carboxylic acid permionic membrane and the porous, catalytic cathode enhance one another. While carboxylic acid groups are less conductive than sulfonic acid groups, carboxylic acid permionic membranes, as described herein, used in conjunction with catalytic cathodes have higher current efficiencies than sulfonic acid permionic membranes used in conjunction with catalytic cathodes. This results in a lower energy requirement per unit of alkali metal hydroxide produced, reported as kilowatt hours per ton, for the carboxylic acid permionic membrane-catalytic cathode combination than for the sulfonic acid permionic membrane-catalytic cathode combination.

The higher energy efficiency, i.e., the lower kilowatt hours per ton of product, of the carboxylic acid membrane-catalytic cathode combination is surprising. While not intending to be bound by this hypothesis, it is believed that the higher energy efficiency of carboxylic acid membrane-catalytic cathode combination is due to the synergistic effect of the low hydrogen overvoltage cathode combined with the high perm-selectivity of the within described carboxylic acid membrane, including the ability of the carboxylic acid membrane material to maintain a high degree of permselectivity at the alkali metal hydroxide contents herein contemplated as well as the ability of the electrode material to function at the high alkali metal hydroxide contents herein contemplated. The increased energy efficiency may also be due to the formation of a film or layer of a metal carboxylate salt of a metal other than sodium on the cathode facing surface of the permionic membrane. Generally, this metal will be a transition metal, e.g., a metal forming a constituent of the cathode substrate or cathode surface.

DETAILED DESCRIPTION OF THE INVENTION

The fluorocarbon resin permionic membrane used in combination with the catalytic cathode is characterized by the presence of carboxylic acid type ion exchange groups, the ion exchange capacity of the membrane, the concentration of ion exchange groups in the membrane on the basis of water absorbed in the membrane, and the glass transition temperature of the membrane material.

The membrane material herein contemplated has an ion exchange capacity from about 0.5 to about 2.0 milligram equivalents per gram of dry polymer, and preferably from about 0.9 to about 1.8 milligram equivalents per gram of dry polymer, and in a particularly preferred exemplification, from about 1.1 to about 1.7 milligram equivalents per gram of dry polymer. When the ion exchange capacity is less than about 0.5 milligram equivalents per gram of dry polymer the current efficiency is low at the high concentrations of alkaline metal hydroxide herein contemplated, while when the ion exchange capacity is greater than about 2.0 milligram equivalents per gram of dry polymer, the water content of the membrane is higher, thereby reducing the current efficiency.

The content of ion exchange groups per gram of absorbed water is from about 8 milligram equivalents per gram of absorbed water to about 30 milligram equivalents per gram of absorbed water and preferably from about 10 milligram equivalents per gram of absorbed water to about 28 milligram equivalents per gram of absorbed water, and in a preferred exemplification from about 14 milligram equivalents per gram of absorbed water to about 26 milligram equivalents per gram of absorbed water. When the content of ion exchange groups per unit weight of absorbed water is less than about 8 milligram equivalents per gram the resistivity is too high while when the content of ion exchange groups is above about 30 milligram equivalents per gram the current efficiency is too low.

The glass transition temperature is preferably about 20° centigrade below the temperature of the electrolyte. When the electrolyte temperature is between about 95° C. and 110° C., the glass transition temperature of the fluorocarbon resin permionic membrane material is below about 80° centigrade and in a particularly preferred exemplification below about 70° centigrade. However, the glass transition temperature should be above about minus 80° centigrade in order to provide satisfactory tensile strength of the membrane material. Preferably the glass transition temperature is from about minus 80° centigrade to about 70° centigrade and in a particularly preferred exemplification from about minus 80° centigrade to about 50° centigrade.

When the glass transition temperature of the membrane is within about 20° C. of the electrolyte, or higher than the temperature of the electrolyte, the resistance of the membrane increases and the perm-selectivity of the membrane decreases. By glass transition temperature is meant the temperature below which the polymer segments are not energetic enough to either move past one another or with respect to one another by segmental Brownian motion. That is, below the glass transition temperature, the only reversible response of the polymer to stresses is strain while above the glass transition temperature the response of the polymer to stress is segmental rearrangement to relieve the externally applied stress.

The fluorocarbon resin permionic membrane materials contemplated herein have a water permeability of less than about 100 milliliters per hour per square meter at 60° centrigrade in four normal sodium chloride at a pH of 10 and preferably lower than 10 milliliters per hour per square meter at 60° centigrade in four normal sodium chloride of the pH of 10. Water permeabilities higher than about 100 milliliters per hour per square meter, measured as described above, may result in an impure alkali metal hydroxide product.

The electrical resistance of the dry membrane should be from about 0.5 to about 10 ohms per square centimeter and preferably from about 0.5 to about 7 ohms per square centimeter.

Preferably the fluorinated-resin permionic membrane has a molecular weight, i.e., a degree of polymerization, sufficient to give a volumetric flow rate of about 100 cubic millimeters per second at a temperature of from about 150° to about 300° centigrade.

The fluorocarbon resins therein contemplated have the moieties:

$$\left(CF_2-CXX'\right) \quad \text{and} \quad \left(CF_2-\underset{\underset{Y}{|}}{C}-X\right)$$

where X is —F, —Cl, —H, or —CF; X' is —F, —Cl, —H, $-CF_3$ or $CF_3(CF_2)_m$—; m is an integer of 1 to 5; and Y is —A, —$\phi$—A, —P—A, or —O—$(CF_2)_n$(P, Q, R)—A.

In the unit (P,Q,R), P is $-(CF_2)_a(CXX')_b(CF_2)_c$, Q is $(-CF_2-O-CXX')_d$, R is $(-CXX'-O-CF_2)_e$, and (P,Q,R) contains one or more of P, Q, R.

$\phi$ is the phenylene group; n is 0 or 1; a, b, c, d and e are integers from 0 to 6; A may be either —COOH or a functional group which can be converted to —COOH by hydrolysis or neutralization such as —CN, —COF, $-COOR_1$, —COOM, $-CONR_2R_3$; $R_1$ is e $C_{1-10}$ alkyl group; M is an alkali metal or a quaternary ammonium group, and $R_2$ and $R_3$ respectively are hydrogen or a $C_{1-10}$ alkyl group when m is an alkali metal it is most preferably sodium or potassium.

The typical groups of Y have the structure with the acid group, A, connected to a carbon atom which is connected to a fluorine atom. These include $$\left(CF_2\right)_x A,\ -O\left(CF_2\right)_x A,\ \left(O-CF_2-\underset{\underset{Z}{|}}{CF}\right)_y A,$$

$$\left(O-CF_2-\underset{\underset{Z}{|}}{CF}\right)_x\left(O-CF-CF_2\right)_y A, \text{ and}$$

$$-O-CF_2\left(CF-O-\underset{\underset{Z}{|}}{CF}\right)_x\left(CF_2\right)_y\left(CF_2-O-\underset{\underset{R}{|}}{CF}\right)_z A$$

where x, y, and z are respectively 1 to 10; Z and R are respectively —F and a $C_{1-10}$ perfluoroalkyl group, and A is the acid group as defined above.

In the case of copolymers having the olefinic and olefin-acid moieties above described, it is preferable to have 1 to 40 mole percent, and preferably especially 3 to 20 mole percent of the olefin-acid moiety units in order to produce a membrane having an ion-exchange capacity within the aforesaid range.

In the membrane-cathode combination herein contemplated, the cathode has a catalytic surface thereon. In a preferred exemplification the surface is of a different material than the cathode substrate, for example a non-ferrous surface on a ferrous substrate.

By a non-ferrous surface is meant that the electrolytic behavior of the surface is characteristic of the non-ferrous component although either residual iron, or compounds of iron may be present in the cathode surface, and that the hydrogen evolution over-voltage of the surface is lower than the hydrogen evolution over-voltage of iron.

Preferably the surface is porous. By a porous surface is meant molecular level porosity. The porosity may be in the form of pores, imperfections, crystal dislocations, irregular crystals, acicular filaments, or the pore structure obtained by leaching one member of an alloy or mixture and crystal boundaries. These pores are of a size corresponding to the order of about 10 microns. Preferably, an electrolytically significant fraction of the pores and dislocations are smaller than 10 microns and in a particularly preferred exemplification, at least about 50 percent of the pores and crystal dislocations are smaller than about 10 microns. The porosity of the surface as distinct from the substrate should be greater than 20 percent, and in a particularly preferred exemplification greater than 70 percent or even 75 percent. The catalytic surfaces herein contemplated generally have a thickness of at least about 0.001 inch.

By a catalytic surface is meant that the surface has a hydrogen evolution potential, including hydrogen over-voltage, of less than about 1.20 volt and preferably less than about 1.15 volt in alkaline media.

Specially preferred are materials that are resistant to concentrated alkali metal hydroxides, for example, 40 percent aqueous sodium hydroxide, at temperatures above about 100° centigrade, and preferably 115° centigrade or even higher.

The materials herein contemplated for forming the surface of the cathode include cobalt, nickel, iron, maganese, ruthenium, platinum, palladium, rhodium, osmium, iridium, rhenium, titanium, tungsten, tantalum, niobium, molybdenum and lead. They may be present as alloys or as compounds such as, carbides, nitrides, borides, oxides, sulfides and aluminides. Typical aluminides include the aluminides of cobalt, nickel, platinum, molybdenum, tungsten, manganese, iron, palladium, and niobium.

One particularly desirable porous, catalytic surface is provided by nickel. While different methods of forming the porous nickel surface, and the presence of various alloys, additives, and compounds provide different catalytic cathodes, it is believed that the combination of carboxylic acid type permionic membrane with a porous nickel cathode surface, where the surface includes alloys, additives, and the like, and is prepared by various methods, provides a particularly desirable cathode.

One particularly desirable porous nickel cathode surface is provided by co-depositing iron and nickel, for example, by electroless deposition, and thereafter leaching the iron out whereby to provide a porous nickel surface. When the nickel-iron surface is deposited by hypophoshite reduction some nickel phosphide may be present in the surface.

Another particularly desirable porous nickel surface is provided by the presence of a hydrogen over-voltage reducing amount of molybdenum in and on the porous nickel surface. The molybdenum is present in an amount of from two percent to about fifty percent, and preferably from five percent to about 35 percent of the surface, basis total nickel and molybdenum calculated as the metals. The molybdenum may be present as elemental molybdenum, or as an alloy with the nickel, or as an alkali-resistant compound, e.g., a carbide, a nitride, a boride, a sulfide, an oxide, a silicide, or a phosphide.

Another particularly desirable surface may be provided by depositing the catalytic surface or precursor thereof as a molten metal onto a substrate, e.g., by flame spraying or plasma spraying cobalt, iron, nickel, platinum, molybdenum, tungsten, manganese, iron, or niobium, or carbides, nitrides, or aluminides thereof, with a leachable component onto a suitable substrate, and thereafter leaching out the leachable component. Especially preferred materials for preparing a surface in this way are nickel, cobalt, molybdenum, tungsten, and their carbides.

Another particularly desirable surface may be provided by codepositing an alkali-resistant metal such as nickel, cobalt, chromium, manganese, or iron with a leachable metal such as zinc, aluminum, magnesium, tin, gallium, lead, cadmium, bismuth, or antimony, and leaching out the leachable metal whereby to provide a porous surface of nickel, cobalt, chromium, manganese, or iron.

Another particularly desirable catalytic cathode coating may be provided by depositing, for example, melt spraying, and thereafter leaching a mixture of zirconium with either nickel or cobalt and a leachable material, and leaching out the leachable material whereby to provide a surface of zirconium with either nickel, or cobalt, or both.

Another catalytic cathode useful in combination with the perfluorocarbon carboxylic acid permionic membrane is one having a surface of an alloy of palladium, for example with silver or lead. Alternatively, the coating may be cobalt, or an intermediate coating of cobalt with an external coating of ruthenium, or a ruthenium compound, or rhenium.

A still further catalytic material, which behaves differently than a ferrous surface is iron with either a sulfide such as lead sulfide or molybdenum sulfide, or with molybdenum such as elemental molybdenum, or an iron-molybdenum alloy, or a molybdenum compound as molybdenum carbide, molybdenum nitride, molybdenum oxide, molybdenum phosphide, or molybdenum silicide.

According to a still further exemplification of this invention, the catalytic, cathode surface may be a metallic compound, for example, compound of either cobalt or nickel, with tungsten and either phosphorous or boron. The surface may be formed by heating, for example, to provide cobalt or nickel oxides and an intermediate layer of tungsten or tungsten oxide.

According to a still further exemplification of this invention the cathode may be an electroconductive substrate having a perovskite where the perovskite has the empirical formula $A_xB_yO_z$ where A may be nickel, copper, or cobalt, B may be nickel, copper, cobalt, titanium, a lanthanide, magnesium, or boron, O is oxygen and x, y, and z are small numbers.

The cathode substrate is a material that is electrically conductive, and either resistant to concentrated alkali metal hydroxide or bearing a coating of a material that is so resistant. The substrate may be iron, nickel, cobalt, copper, titanium, titanium hydride, molybdenum, tungsten, zirconium, hafnium, or the like. Preferably, a layer of metal particularly resistant to concentrated alkali metal hydroxide solutions is interposed between the catalytic surface and the substrate. This may be provided, for example, by a thin layer of nickel on the substrate between the catalytic surface and the substrate.

The position of the anode and cathode relative to the permionic membrane is reported to have an effect on the current efficiency and cell voltage. The membrane can bear upon the cathode, as in the case of deposited diaphragms or it can be separated from the cathode by a film of electrolyte between the cathode and the membrane, as where the membrane is borne by the cathode but separated therefrom by spacer means.

Alternatively, the membrane can bear on the anode, for example, on the active surface of the anode facing the cathode, or on an inactive surface of the anode facing the cathode. According to a still further exemplification, the membrane can be nearer the anode than the cathode but spaced from the surface of the anode with a layer or film of electrolyte therebetween, for example, spaced from the anode by suitable spacer means. In this case, the cathode-facing surface of the anode may either have an electrocatalytic coating or may be free of an electrocatalytic coating.

According to a still further exemplification, the membrane can be spaced from both the anode and the cathode and structurally supported by either the anode or the cathode or both, for example, by spacer means, extending therefrom.

According to a still further exemplification a membrane or membranes may be on both the anode and the cathode. For example, a wetted membrane may contact both the anode and the cathode or be spaced equally therefrom by spacer means. According to a still further exemplification, separate membranes may be mounted on both the anode and the cathode with a third electrolyte compartment therebetween.

As herein contemplated, alkali metal chloride brine is fed to the anolyte compartment. Chlorine and depleted brine are recovered from the anolyte compartment, while hydrogen and alkali metal hydroxide are recovered from the catholyte compartment. The brine feed is typically saturated brine, containing from about 300 to about 325 grams per liter of sodium chloride or from about 390 to about 420 grams per liter of potassium chloride. The brine feed may acidified to a pH of about 8 whereby to provide an anolyte pH from about 2.5 to about 5.5. Preferably, the brine feed is substantially free of alkaline earth metals, for example, having a calcium content less than 1 part per million and preferably less than 0.5 or even 0.05 parts per million alkaline earth metals, and preferably less than 0.002 parts per million alkaline earth metals.

The catholyte liquid typically contains from about 35 to about 45 weight percent sodium hydroxide in the case of sodium chloride electrolysis, or from about 45 to about 55 weight percent potassium hydroxide in the case of potassium chloride electrolysis.

Electrolysis is typically carried out at the current density of from about 100 to about 500 amperes per square foot and preferably from about 150 to about 250 amperes per square foot and at an electrolyte temperature from about 90° to 120° centigrade.

The catholyte liquid recovered from the process is substantially free of chlorides.

EXAMPLE

Three catalytic cathodes were prepared and tested in an electrolytic cell having a perfluorocarbon-perfluorocarbon carboxylic acid permionic membrane.

The catalytic cathodes were prepared by first depositing nickel onto each of three five inch by seven inch louvered mesh mild steel sheets, then co-depositing nickel and iron onto the louvered mesh mild steel sheets, and thereafter leaching out the iron in aqueous sodium hydroxide.

The solution utilized for depositing the nickel coating contained:

Sodium citrate: 50 grams per liter;
$NiCl_2.6H_2O$: 30 grams per liter;
$CoCl_2.6H_2O$: 0.5 grams per liter;

$NaH_2PO_2.H_2O$: 10 grams per liter;
$Na_2B_4O_7$ (anhydrous): 1.6 gram per liter;
HCl (12 Normal): to adjust ph to 6.1.

The mesh sheets were plated in the nickel plating solution six hours at 70 degrees Centigrade to provide a nickel film on the steel approximately 22 to 23 microns thick. The mesh sheets were then plated in a nickel-iron plating bath containing:

Sodium citrate: 100 grams per liter;
$NiCl_2.6H_2O$: 30 grams per liter;
$CoCl_2.6H_2O$: 0.5 grams per liter;
$NaH_2PO_2.H_2O$: 10 grams per liter;
$Na_2B_4O_7$ (anhydrous): 1.6 grams per liter;
$FeSO_4.7H_2O$: 7.6 grams per liter.

The pH of the bath was adjusted to 9.12 using 4 Normal NaOH. The mesh sheet was degreased in $CH_2Cl_2$, dipped in 6 Normal HCl for one minute, and then placed in the above plating solution for four hours to provide a coating approximately 10 to 12 microns thick. The sheets were then immersed in 1 weight percent hydrochloric acid for 15 minutes and 2 weight percent sodium hypochlorite solution for 45 minutes to one hour and fifteen minutes. The leached cathodes had less than two percent iron in their porous surfaces.

The three cathodes were then installed in laboratory electrolytic cells. In each cell the cathode was separated from an anode by two 1/16 inch (1.5 mm) gaskets with a perfluorinated resin permionic membrane between the two gaskets.

The permionic membranes were a copolymers of a perfluorinated olefin and a perfluorinated olefin carboxylic acid having an ion exchange capacity between 1.1 and 17. milligram equivalents of ion exchange groups per gram of adsorbed water.

The results for the three catalytic cathode-permionic membrane cells are as shown in the tables below:

TABLE A

| Operating Period, Days | Cell Volts (190ASF) | Catholyte Liquor, Weight Percent NaOH, | Cathode Potential Versus Ag/AgCl /KCl | Cathode Efficiency % | Kilowatt Hours Per Ton of NaOH |
|---|---|---|---|---|---|
| 14–30 | 3.46 | 36.0 | −1.27 | 95.9 | 2198 |
| 31–60 | 3.39 | 33.4 | −1.27 | 95.7 | 2138 |
| 61–90 | 3.39 | 33.9 | −1.32 | 94.5 | 2147 |

TABLE B

| Operating Period, Days | Cell Volts (190ASF) | Catholyte Liquor, Weight Percent NaOH | Cathode Potential Versus Ag/AgCl /KCl | Cathode Efficiency % | Kilowatt Hours Per Ton of NaOH |
|---|---|---|---|---|---|
| 14–30 | 3.40 | 37.7 | −1.30 | 94.7 | 2180 |
| 31–60 | 3.37 | 37.5 | −1.33 | 95.2 | 2149 |
| 61–78 | 3.24 | 34.0 | −1.30 | 96.0 | 2056 |

TABLE C

| Operating Period, Days | Cell Volts (190ASF) | Catholyte Liquor, Weight Percent NaOH | Cathode Potential Versus Ag/AgCl /KCl | Cathode Efficiency % | Kilowatt Hours Per Ton of NaOH |
|---|---|---|---|---|---|
| 4–30 | 3.29 | 34.9 | −1.28 | 95.9 | 2085 |

TABLE C-continued

| Operating Period, Days | Cell Volts (190ASF) | Catholyte Liquor, Weight Percent NaOH | Cathode Potential Versus Ag/AgCl /KCl | Cathode Efficiency % | Kilowatt Hours Per Ton of NaOH |
|---|---|---|---|---|---|
| 31–60 | 3.34 | 33.8 | −1.30 | 96.6 | 2104 |
| 61–90 | 3.33 | 35.2 | −1.29 | 96.6 | 2089 |

While the invention has been described with reference to certain exemplifications and embodiments thereof it is not to be so limited except as in the claim appended hereto.

We claim:

1. In a process of producing alkali metal hydroxide comprising electrolyzing an aqueous alkali metal chloride brine in an electrolytic cell having an anode, a cathode comprising a substrate with a catalytic surface thereon, said anode being separated from cathode by a synthetic fluorocarbon resin permionic membrane, the improvement wherein a. said flurocarbon resin perminoic membrane is a fluorinated copolymer having carboxylic acid ion exchange groups; and b. said cathode catalytic surface is a non-ferrous, porous, catalytic, surface.

2. The process of claim 1 wherein the cathode comprises an electroconductive ferrous substate, and a non ferrous, porous, catalytic surface thereon.

3. The process of claim 2 wherein the non-ferrous, porous, catalytic surface comprises nickel.

4. The process of claim 3 wherein the non-ferrous, porous, catalytic surface comprises nickel and molybdenum.

5. The process of claim 2 wherein the non-ferrous, porous, catalytic surface comprises cobalt oxide.

6. The process of claim 5 wherein the non-ferrous, porous, catalytic surface further comprises tungsten and phosphorus.

7. The process of claim 1 wherein the fluorinated polymer has the moieties $$\left(CF_2-CXX'\right) \quad \text{and}$$

$$\left(CF_2-\underset{\underset{Y}{|}}{C}-X''\right)$$

where X is —F, —Cl, H or $-CF_3$; X′ and X″ respectively are —F, —Cl, —H, $-CF_3$ or $CF_3(CF_2)_m-$; m is 1 to 5; Y is —A, —ϕ—A, —P—A, $-O(CF_2)_n(P,Q,R)-A$, wherein at least one of P, Q, R are present and P is $-(CF_2)_a(CXX,)_b(CF_2c$; Q is $-(CF_2-O-CXX')_d$; R is $-(CXX'-O-CF_2)_e$ and ϕ is a phenylene group; X and X′ are defined above; n is 0 or 1; a, b, c, d, and e respectively 0 to 6; A is —COOH or a functional group which can be coverted to —COOH chosen from the group consisting of —CN, —COF, —COOR, —COOM, $-CONR_2R_3$; $R_1$ is a $C_{1-10}$ alkyl group; M is chosen from the group consisting of alkali metals and a quaternary ammonium group, and $R_2$ and $R_3$ respectively are hydrogen atom or a $C_{1-10}$ alkyl group.

8. The process of claim 7 wherein Y is selected from the group consisting of $$\left(CF_2\right)_x A,\ -O\left(CF_2\right)_x A,\ \left(O-CF_2-\underset{\underset{Z}{|}}{CF}\right)_y A,$$

$$\left(O-CF_2-\underset{\underset{Z}{|}}{CF}\right)_x\left(O-CF-CF_2\right)_y A, \text{ and}$$

$$-O-CF_2\left(CF-O-\underset{\underset{Z}{|}}{CF}\right)_x\left(CF_2\right)_y\left(CF_2-O-\underset{\underset{R}{|}}{CF}\right)_z A$$

where x, y, and z are respectively 1 to wherein x, y, and z respectively are 1 to 10; Z and R respectively are —F and a $C_{1-10}$ perfluoroalkyl group.

9. In a process of producing alkali metal hydroxide comprising electrolyzing an aqueous alkali metal chloride brine in an electrolytic cell having an anode, a cathode comprising a substrate with a catalytic surface thereon, said anode separated from cathode by a synthetic fluorocarbon resin permionic membrane, the improvement wherein a. said fluorocarbon resin permionic membrane is a fluroinated copolymer having carboxylic acid ion exchange groups; and b. said cathode catalytic surface is a non-ferrous, porous catalytic, nickel surface.

10. The process of claim 9 wherein the non-ferrous, porous, catalytic, nickel surface consists essentially of nickel and molybdenum.

11. In a process of producing alkali metal hydroxide, comprising electrolyzing alkali metal chloride brine in an electrolytic cell having an anode, a cathode comprising a substrate with a catalytic surface thereon, said anode being separated from said cathode by a synthetic fluorocarbon resin permionic membrane, the improvement where:

(a) said fluorocarbon is a fluorinated copolymer having carboxylic acid ion exchange groups; and (b) said cathode catalytic surface is a non-ferrous, porous, catalytic surface comprising cobalt oxide.

12. The process of claim 11 wherein the non-ferrous, porous, catalytic surface further comprises tungsten and phosphorous.

13. In an electrolytic cell having an anode, a cathode comprising a substrate with a catalytic surface thereon, and a synthetic flurocarbon resin perminoic membrane therebetween, the improvement wherein:

a. said flurocarbon resin permionic membrane is a fluorinated copolymer having carboxylic acid ion exchange groups; and b. said cathode, catalytic surface is a non-ferrous, porous, catalytic surface.

14. The electrolytic cell of claim 13 wherein the cathode comprises an electroconductive, ferrous substate, and a non-ferrous, porous catalytic surface thereon.

15. The electrolytic cell of claim 14 wherein the non-ferrous, porous, catalytic surface comprises nickel.

16. The electrolytic cell of claim 15 wherein the non-ferrous, porous, catalytic surface comprises nickel and molybdenum.

17. The electrolytic cell of claim 14 wherein the non-ferrous, porous, catalytic surface comprises cobalt oxide.

18. The electrolytic cell of claim 17 wherein the non-ferrous, porous, catalytic surface further comprises tungsten and phosphorous.

19. The electrolytic cell of claim 13 wherein the fluorinated polymer has the moieties $$\left(CF_2-CXX'\right) \text{ and } CF_2-\underset{\underset{Y}{|}}{C}-X''$$

where X is —F, —Cl, —H or —$CF_3$; X; and X″ respectively are —F, —Cl, —H, —$CF_3$ or $CF_3(CF_2)_m$—; m is 1 to 5; Y is —A, —$\phi$—A, —P—A, —$O(CF_2)_n$(P,Q,-R)—A, wherein at least one of P, Q, and R are present and P is —$(CF_2)_a$ $(CXX')_b(CF_2)_c$; Q is —(C-$F_2$—O—CXX')$_d$; R is —(CXX′—O—$CF_2)_e$ ahd $\theta$ a phenylene group; X and X′ are defined above; n is 0 or 1; a, b, c, d, and e are respectively 0 to 6; A is —COOH or a functional group which can be coverted to —COOH chosen from the group consisting of —CN, —COF, —COOR, —COOM, —$CONR_2R_3$; $R_1$ is a $C_{1-10}$ alkyl group; M is chosen from the group consisting of an alkali metal and a quaternary ammonium group, and $R_2$ and $R_3$ are respectively a hydrogen atom or a $C_{1-10}$ alkyl group.

20. The electrolytic cell of claim 19 wherein Y is selected from the group consisting of $$\left(CF_2\right)_x A,\ -O\left(CF_2\right)_x A,\ \left(O-CF_2-\underset{\underset{Z}{|}}{CF}\right)_y A,$$

$$\left(O-CF_2-\underset{\underset{Z}{|}}{CF}\right)_x\left(O-CF-CF_2\right)_y A, \text{ and}$$

$$-O-CF_2\left(CF-O-\underset{\underset{Z}{|}}{CF}\right)_x\left(CF_2\right)_y\left(CF_2-O-\underset{\underset{R}{|}}{CF}\right)_z A$$

wherein x, y, and z respectively are 1 to 10; Z and R respectively are —F and a $C_{1-10}$ perfluoroalkyl group.

21. In an electrolytic cell having an anode, a cathode comprising a substrate with a catalytic surface thereon, and a synthetic fluorocarbon resin permionic membrane therebetween, the improvement wherein:

a. said fluorocarbon resin permionic membrane is a fluorinated copolymer having carboxylic acid ion exchange groups and b. said cathode surface is a porous, non-ferrous catalytic nickel surface.

22. The electrolytic cell of claim 21 wherein the porous, non-ferrous, catalytic nickel surface consists essentially of nickel and molybdenum.

23. In an electrolytic cell having an anode, a cathode comprising a substrate with a catalytic surface thereon, and a synthetic fluorocarbon resin permionic resin therebetween, the improvement wherein:

(a) said fluorocarbon is a fluorinated copolymer having carboxylic acid ion exchange groups; and (b) said cathode catalytic surface is a non-ferrous, porous, catalytic surface comprising cobalt oxide.

24. The electrolytic cell of claim 23 wherein the non-ferrous, porous, catalytic surface further comprises tungsten and phosphorous.

* * * * *